US008305411B1

(12) United States Patent
Yamamoto

(10) Patent No.: US 8,305,411 B1
(45) Date of Patent: Nov. 6, 2012

(54) THERMAL PRINTHEAD WITH TEMPERATURE REGULATION

(75) Inventor: Tadashi Yamamoto, San Diego, CA (US)

(73) Assignee: Rohm Semiconductor USA, LLC, San Diego, CA (US)

( * ) Notice: Subject to any disclaimer, the term of this patent is extended or adjusted under 35 U.S.C. 154(b) by 43 days.

(21) Appl. No.: 13/160,494

(22) Filed: Jun. 14, 2011

(51) Int. Cl.
*B41J 2/375* (2006.01)

(52) U.S. Cl. ..... 347/223

(58) Field of Classification Search ..... 347/223, 347/222, 62, 17, 19
See application file for complete search history.

(56) References Cited

U.S. PATENT DOCUMENTS

| | | | | |
|---|---|---|---|---|
| 3,931,492 | A | 1/1976 | Takano et al. | |
| 4,262,188 | A | 4/1981 | Beach | |
| 4,797,837 | A * | 1/1989 | Brooks | 347/223 |
| 4,819,011 | A | 4/1989 | Yokota | |
| 5,483,274 | A | 1/1996 | Inoue et al. | |
| 5,677,721 | A | 10/1997 | Suzuki et al. | |
| 5,714,994 | A | 2/1998 | Suzuki et al. | |
| 2001/0001558 | A1 | 5/2001 | Ishinaga et al. | |
| 2005/0270359 | A1 | 12/2005 | Katsuma et al. | |
| 2008/0211840 | A1 | 9/2008 | Zevin et al. | |

FOREIGN PATENT DOCUMENTS

| | | | |
|---|---|---|---|
| JP | 2000-025253 | A | 1/2000 |
| JP | 2001-232830 | A | 8/2001 |
| JP | 2001-270140 | A | 10/2001 |
| JP | 2004-142356 | A | 5/2004 |
| JP | 2007-144890 | A | 6/2007 |
| JP | 2007-331357 | A | 12/2007 |

OTHER PUBLICATIONS

Applicant brings the attention of the Examiner to the following pending U.S. Appl. No. 13/160,503, filed Jun. 14, 2011 and U.S. Appl. No. 13/160,499, filed Jun. 14, 2011.

* cited by examiner

*Primary Examiner* — Kristal Feggins
(74) *Attorney, Agent, or Firm* — Chen Yoshimura LLP

(57) ABSTRACT

A thermal printhead having a temperature regulation feature which is capable of high speed and high quality printing is provided. The thermal printhead includes a substrate, a resistor layer formed on one surface of the substrate, a control section and a thermoelectric element formed in direct contact with the other surface of the substrate opposite to where the resistor layer is formed, wherein the control section is configured to cool the resistor layer using the thermoelectric element.

23 Claims, 10 Drawing Sheets

THERMAL PRINTHEAD WITH TEMPERATURE REGULATION

BACKGROUND OF THE INVENTION

1. Field of the Invention

The present invention relates to a thermal printhead, and more particularly, to a thermal printhead used for thermal printing having a temperature regulation feature.

2. Description of the Related Art

Thermal printing techniques have been widely used in such areas as portable/mobile, retail, gaming/lottery, and medical due to several advantages over other types of printing techniques such as inkjet, laser or ribbon. Some examples of the advantages are quiet operation, light weight due to a simple structure, no need for ink, toner, or ribbon to replace, and the like. With these advantages, thermal printers based on the thermal printing techniques are used in a variety of devices under a wide range of environments. In particular, thermal printers are likely to be subjected to a wider range of temperatures compared with other types of printers which are mainly used in offices or in a house. As thermal printers rely on heat to print images onto a thermosensitive paper, there is a need for a thermal printhead used in a thermal printer that can offer a reliable fast printing without deterioration of the printing quality even in an extreme ambient temperature.

FIG. 1 shows a simplified cross-sectional view of a conventional thermal printhead B1. The thermal printhead B1 includes a substrate 101, a resistor layer 102, a heatsink 105, a drive IC 106 and a platen 120. In printing an image using the thermal printhead B1, a portion of the resistor layer 102 which constitutes a heating element to imprint a dot is heated by supplying electrical power. When a series of dots is to be printed, this particular portion of the resistor layer 102 is repeatedly supplied with electrical power with power on times in between power off times and the series of dots is printed onto a thermosensitive paper 121 during the power on times. If the series of dots is a long one, the temperature buildup of the resistive layer 102 may occur. Particularly, when On/Off switching speed of supplying electrical power is increased, it may become difficult for the resistive layer 102 to follow the increased switching speed because the resistor layer 102 cannot dissipate the heat fast enough due to the temperature buildup.

In contrast to forced heating of the particular portion of the resistor layer 102 by electrical power, cooling of the particular portion of the resistor layer 102 occurs by conducting heat through the substrate 101 and by dissipating the heat through the heatsink 105 to surrounding air. In other words, cooling time of the heating element of the resistor layer depends on natural cooling which in turn depends on such factors as the combination of the heat capacity of the resistor layer 102, heat capacity and conductivity of the substrate 101 and the heatsink 105 and an ambient temperature of the surrounding air. If, for example, the heat capacities of the resistor layer 102 and the substrate 101 are too large to dissipate the heat in time to follow the On/Off switching speed, problems such as trailing or a blur of a printing dot may occur. Even if the heat capacities of the resistor layer 102 and the substrate 101 are small, if the heatsink 105 cannot dissipate the heat conducted by the resistor layer 102 and the substrate 101 fast enough, the same problems may occur.

SUMMARY OF THE INVENTION

In light of the above and in view of a general trend for faster printing, there exists a need for a thermal printhead capable of a faster printing rate while maintaining clean and high resolution printed images that can be used in such areas as portable/mobile, retail, gaming/lottery, and medical, including such devices as mobile device with a printer, POS, FAX, ATM, and the like.

Accordingly, the present invention is directed to a thermal printhead that fulfills this need.

An object of the present invention is to provide a thermal printhead capable of regulating its temperature within a predetermined range so that a faster printing rate and a better printing quality result.

Additional features and advantages of the invention will be set forth in the descriptions that follow and in part will be apparent from the description, or may be learned by practice of the invention. The objectives and other advantages of the invention will be realized and attained by the structure particularly printed out in the written description and claims thereof as well as the appended drawings.

To achieve these and other advantages and in accordance with the purpose of the present invention, as embodied and broadly described, the present invention provides a thermal printhead including a substrate, a resistor layer formed on one surface of the substrate, a control section and a thermoelectric element formed in direct contact with the other surface of the substrate opposite from where the resistor layer is formed, wherein the control section is configured to cool the resistor layer using the thermoelectric element.

In another aspect, the present invention provides a thermal printhead including a substrate, a resistor layer formed on one surface of the substrate wherein the resistor layer is partitioned into a plurality of resistor layer segments, the resistor layer segment is further partitioned into a plurality of resistor portions, and the resistor portion constitutes a heating element, a plurality of thermoelectric elements formed in direct contact with the other surface of the substrate opposite from where the resistor layer is formed, and a control section, wherein each of the plurality of thermoelectric elements is formed in direct contact with the opposite side of the substrate where corresponding one of the plurality of resistor layer segments is formed, and wherein the control section is configured to cool the resistor layer segment using corresponding one of the thermoelectric elements.

Many benefits are achieved by way of the present invention over conventional techniques. Certain embodiments of the present invention provides a thermal printhead capable of printing at a rate of up to 1300 mm/sec without deterioration of the printing quality due to such factors as trailing, blur, fade, smear or the like that are more common with conventional thermal printheads having a printing speed of up to 300 mm/sec.

It is to be understood that both the foregoing general description and the following detailed description are exemplary and explanatory, and are intended to provide further explanation of the invention as claimed.

DETAILED DESCRIPTION OF THE PREFERRED EMBODIMENTS

Figure 1:
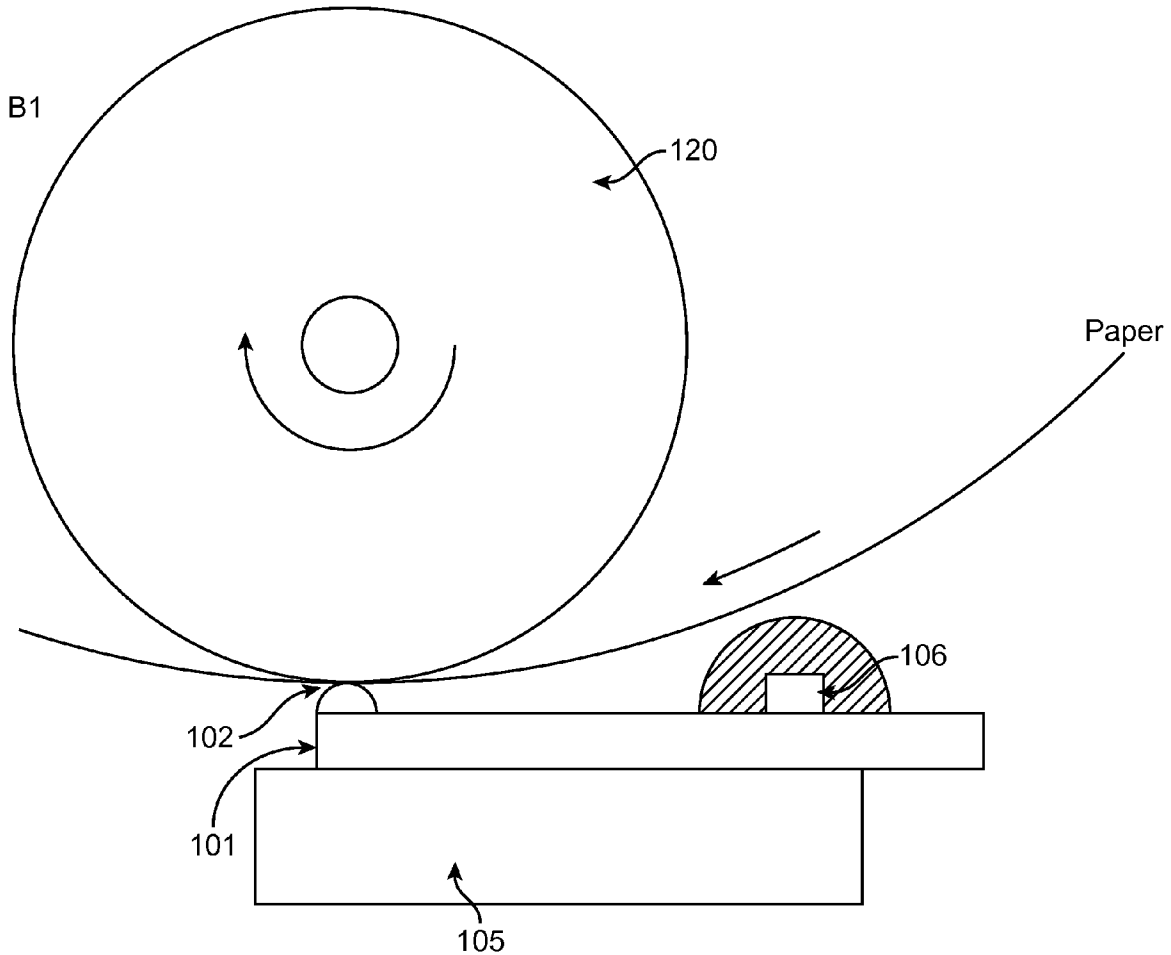
FIG. 1 is a schematic cross sectional view of a conventional thermal printhead.

Embodiments of the present invention provide a thermal printhead with temperature regulation features. The thermal printhead includes a substrate, a resistor layer, a control section, and a thermoelectric element for printing images onto a thermo sensitive paper. The resistor layer is formed on one surface of the substrate of the thermal printhead and the thermoelectric element is formed in direct contact with the opposite surface of the substrate. The thermoelectric element can be a heat transfer device, heat pump, peltier element, thermoelectric converter or the like. During a series of printing images that requires a certain portion of the resistor layer to be heated repeatedly or with a high frequency by supplying electrical power, a temperature buildup of this particular portion of the resistor layer may reach a certain temperature which is detrimental to printing quality. In an embodiment of the present invention, if this temperature is high enough, then the thermoelectric element can generate a current which can be detected by the control section. The control section, in turn, can switch the thermoelectric element to cool the resistor layer for a unit time. In another embodiment, the control section is configured to measure a cumulative electrical power supplied to the particular portion of the resistor layer and when the cumulative electrical power within a unit time is expected to exceed a predetermined amount, preemptively cool the particular portion of the resistor layer using the thermoelectric element, even before the temperature buildup reaches the high temperature detrimental to printing quality. By this preemptive cooling of the resistor layer by the control section using the thermoelectric element, an even faster rate of printing can be achieved without deterioration of the printing quality compared with conventional thermal printheads.

In certain embodiments, the thermal printhead includes a sensor sensing the temperature buildup within the thermal printhead. In case when the temperature buildup sensed by the sensor reaches a predetermined temperature even with the preemptive cooling as described above, this information is fed back to the control section which in turn regulates the thermoelectric element to cool the resistor layer so that deterioration of the printing images due to trailing, blur, smear and the like can be alleviated without slowing down the printing rate.

How fast the thermal printhead can print images without deterioration of the printing quality is determined mainly by the rate of cooling the resistor layer. This rate depends mostly on the combination of a heat capacity and heat conductivities of the substrate, the resistor layer formed thereon and the thermoelectric element, and the rate of heat transfer the thermoelectric element is capable of. In certain embodiments of the present invention, the heat capacity of the substrate, the resistor layer formed thereon and the thermoelectric element is minimized by use of sputtering a thin resistive film on the substrate to form the resistor layer and by having a thermoelectric element formed in direct contact with the substrate eliminating a need to have a thermal conductive member or heatsink in between. In certain other embodiments of the present invention, a plurality of thermoelectric elements is formed in direct contact with the substrate. The resistor layer is further partitioned into a plurality of resistor layer segments, and each of the plurality of resistor layer segments is further partitioned into a plurality of resistor portions. Each resistor portion constitutes a heating element for imprinting a dot onto the thermosensitive paper. Each of the plurality of resistor layer segments has a corresponding thermoelectric element so that any local temperature buildup of certain segments of the resistor layer can be dealt efficiently. By having these features, the temperature buildup of the thermal printhead can be proactively regulated and a printing speed and the quality of printing which were not possible previously with a conventional thermal printhead can be realized.

Figure 2:
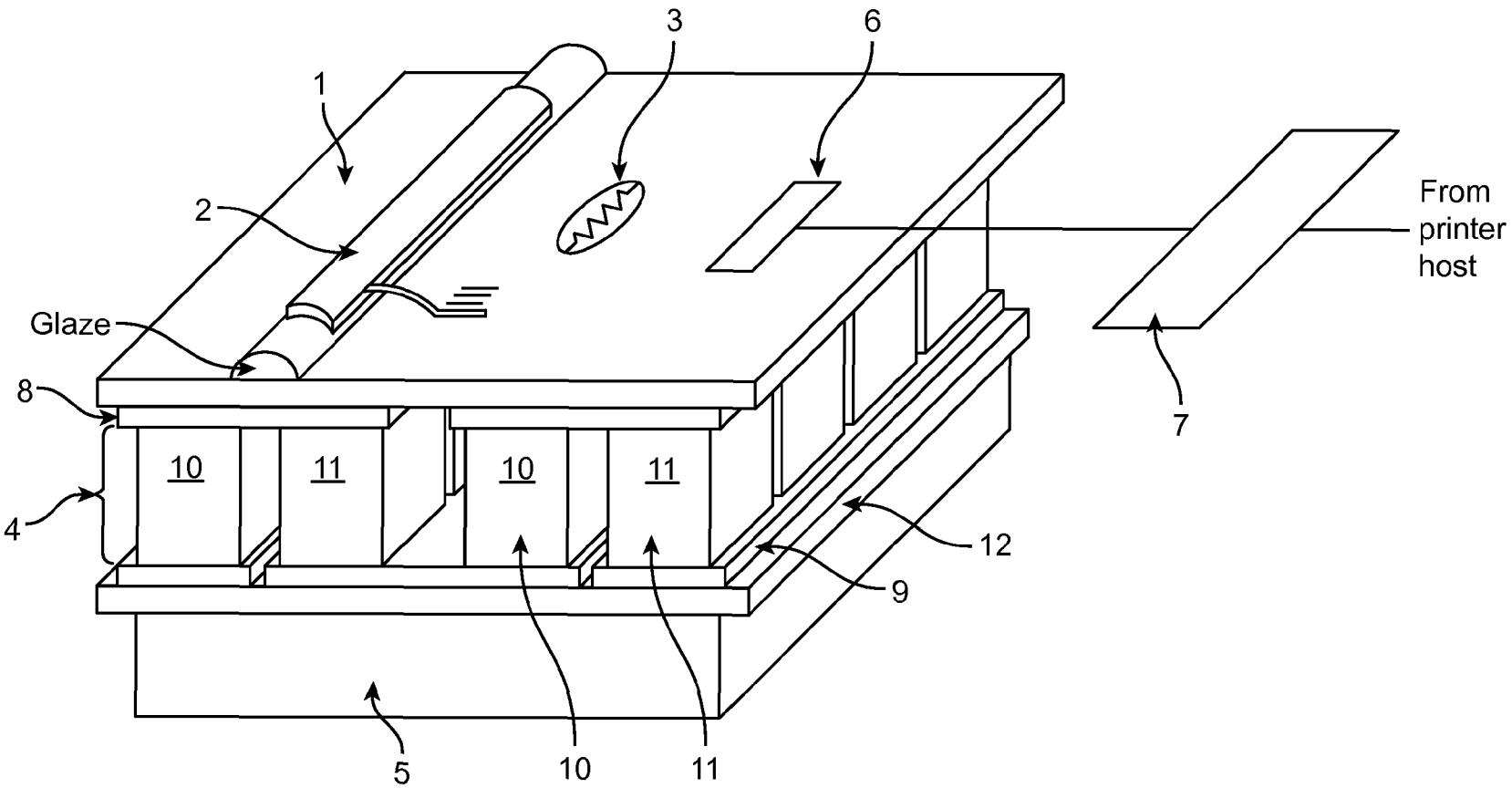
FIG. 2 is a schematic perspective view of a thermal printhead according to an embodiment of the present invention.

FIG. 2 illustrates an example of a thermal printhead according to a first embodiment of the present invention. The thermal printhead includes a substrate 1, a resistor layer 2, a control section 7, a thermoelectric element 4 and a heatsink 5.

Figure 3A:
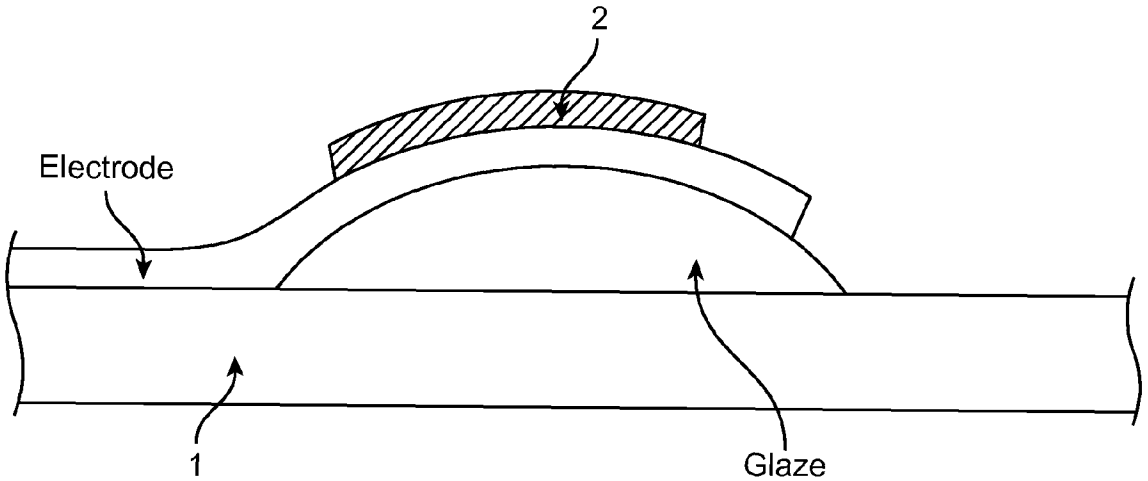
FIG. 3A is a schematic cross sectional view of a thermal printhead according to an embodiment of the present invention.
Figure 3B:
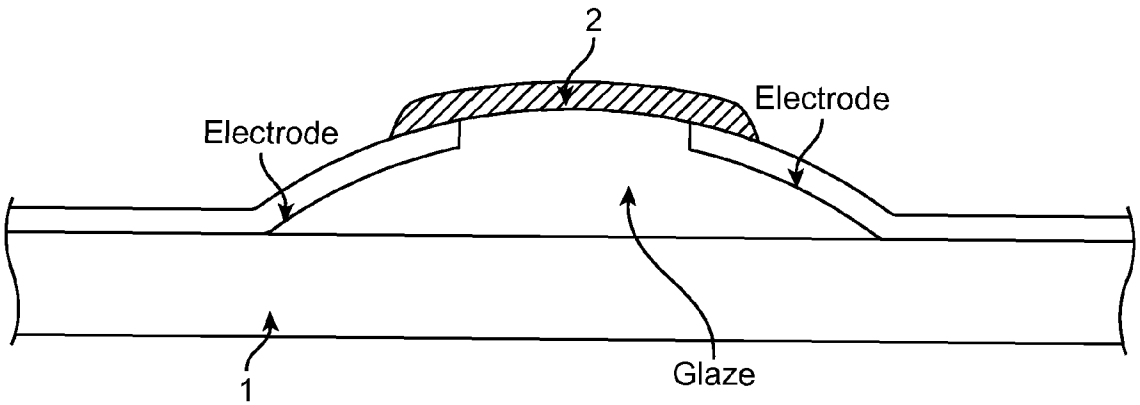
FIG. 3B is a schematic cross sectional view of a thermal printhead according to an embodiment of the present invention.
Figure 3C:
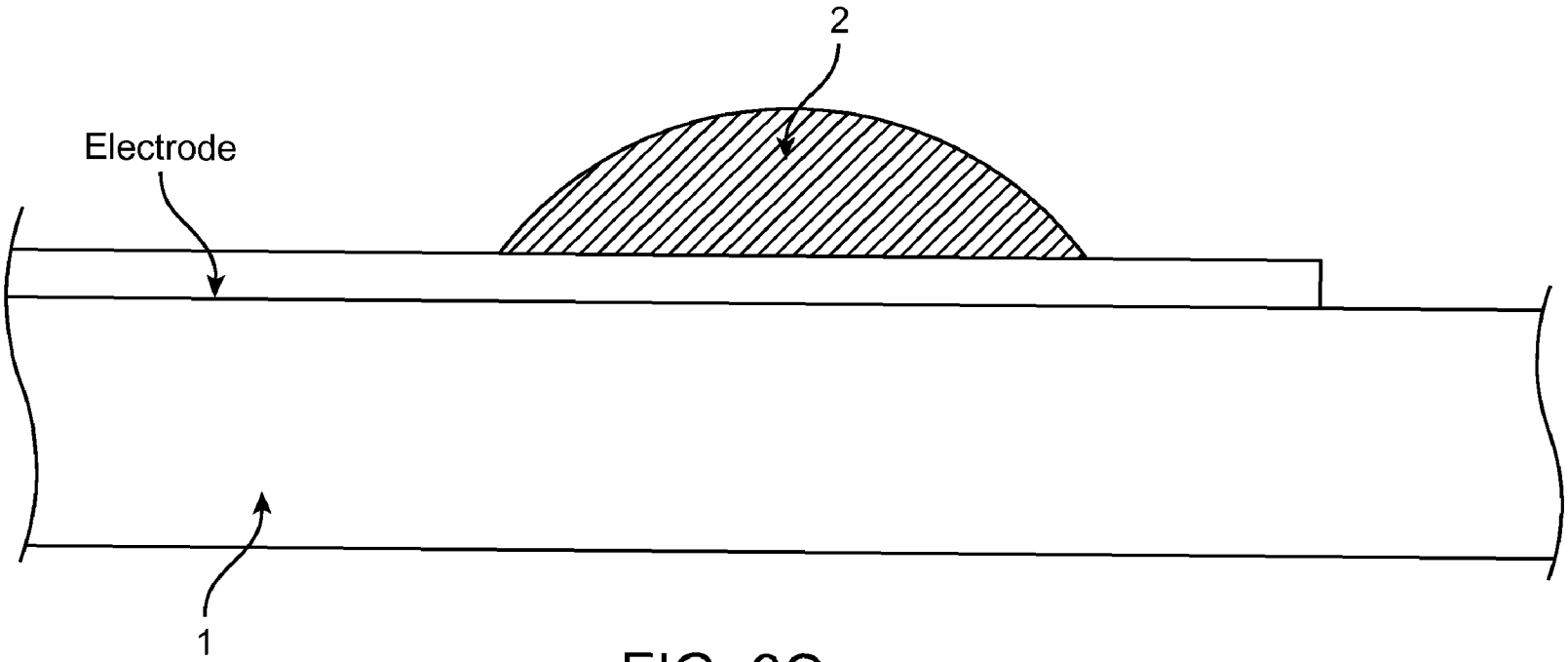
FIG. 3C is a schematic cross sectional view of a thermal printhead according to an embodiment of the present invention.

FIG. 3A shows a cross sectional view of the resistor layer 2 formed on an electrode that is formed partly on a glaze and a surface of the substrate 1. The resistor layer 2 extends in the same direction as the glaze formed on the surface of the substrate 1 as better shown in FIG. 2. The substrate 1 is made of ceramic, resin, metal, glass or the like. The resistor layer 2 can be formed by sputtering a resistive material on the glaze and a part of the electrode on the surface of the substrate 1 to form a thin resistive film. Using such a sputtering method, for example, a thin resistive film with a thickness of 0.05 to 0.2 μm can be formed. Other methods such as chemical vapor deposition (CVD) and the like can also be used to form a thin resistive film. FIG. 3B shows another example of the resistor layer 2. This example shows the common and individual electrodes each disposed on both sides of the glaze and the resistor layer 2 formed thereon partly covering each of the front ends of the common and individual electrodes. FIG. 3C shows yet another example of the resistor layer 2 formed by screen printing an elongated resistor strip as a thick resistor layer on the substrate 1. Such resistor layer may form a rounded top surface and, for example, typically have a thickness of 0.3 to 1.0 μm as show in FIG. 3C. From the perspective of a heat capacity of the resistor layer 2, a thinner resistive film may be advantageous in obtaining a smaller heat capacity of the resistor layer 2 which allows a faster rate of heating/cooling of the resistor layer 2.

Figure 4:
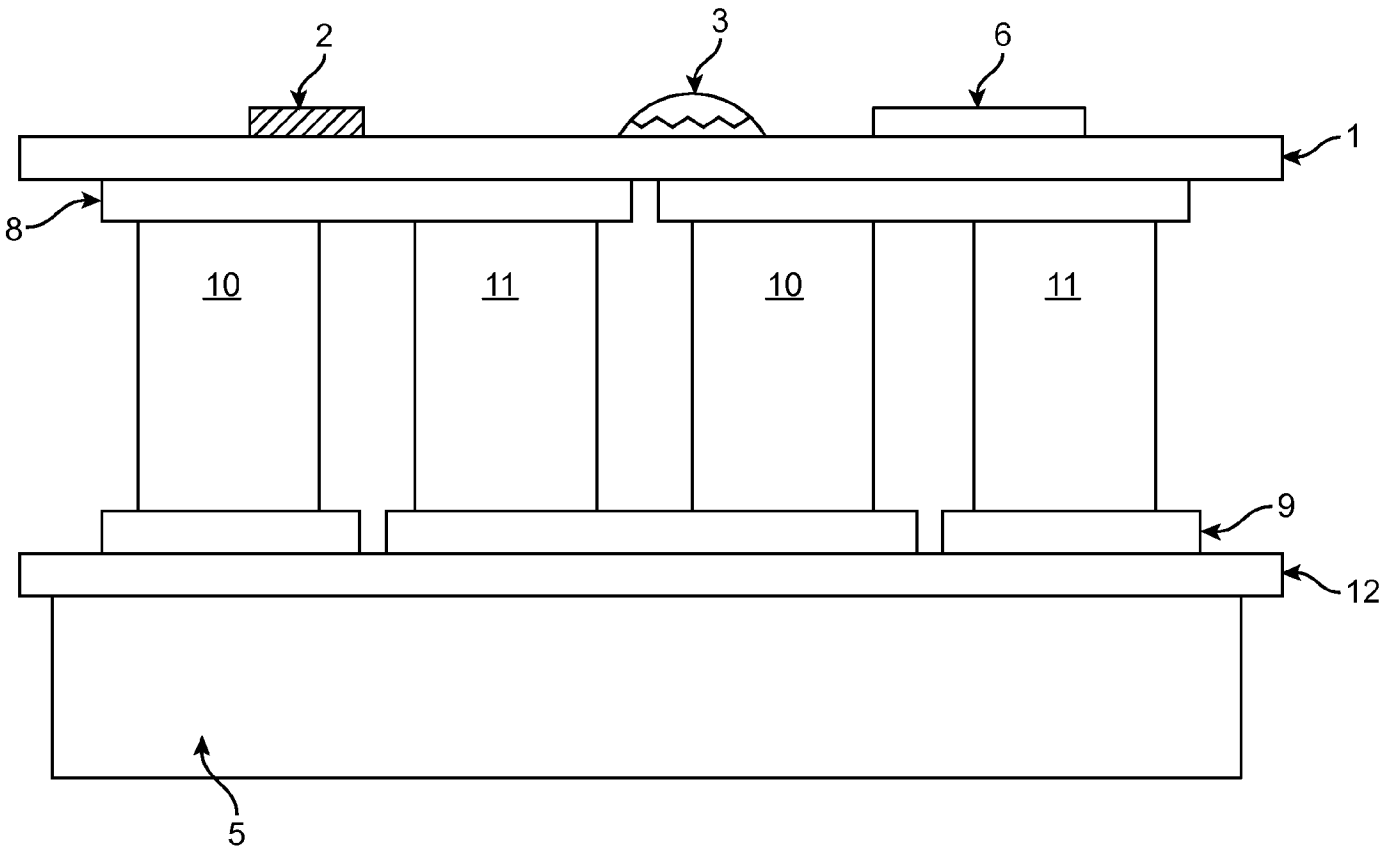
FIG. 4 is a schematic cross sectional view of a thermal printhead including a thermoelectric element according to an embodiment of the present invention.

FIG. 4 shows a schematic cross sectional view of an example of the thermoelectric element 4 formed in direct contact with the thermal printhead. The thermoelectric element 4 can be a heat transfer device, heat pump, peltier element, thermoelectric converter or the like. In FIG. 4, an example of the thermoelectric element 4 based on the peltier effect and formed in direct contact with the substrate 1 of the thermal printhead is shown.

Figure 5:
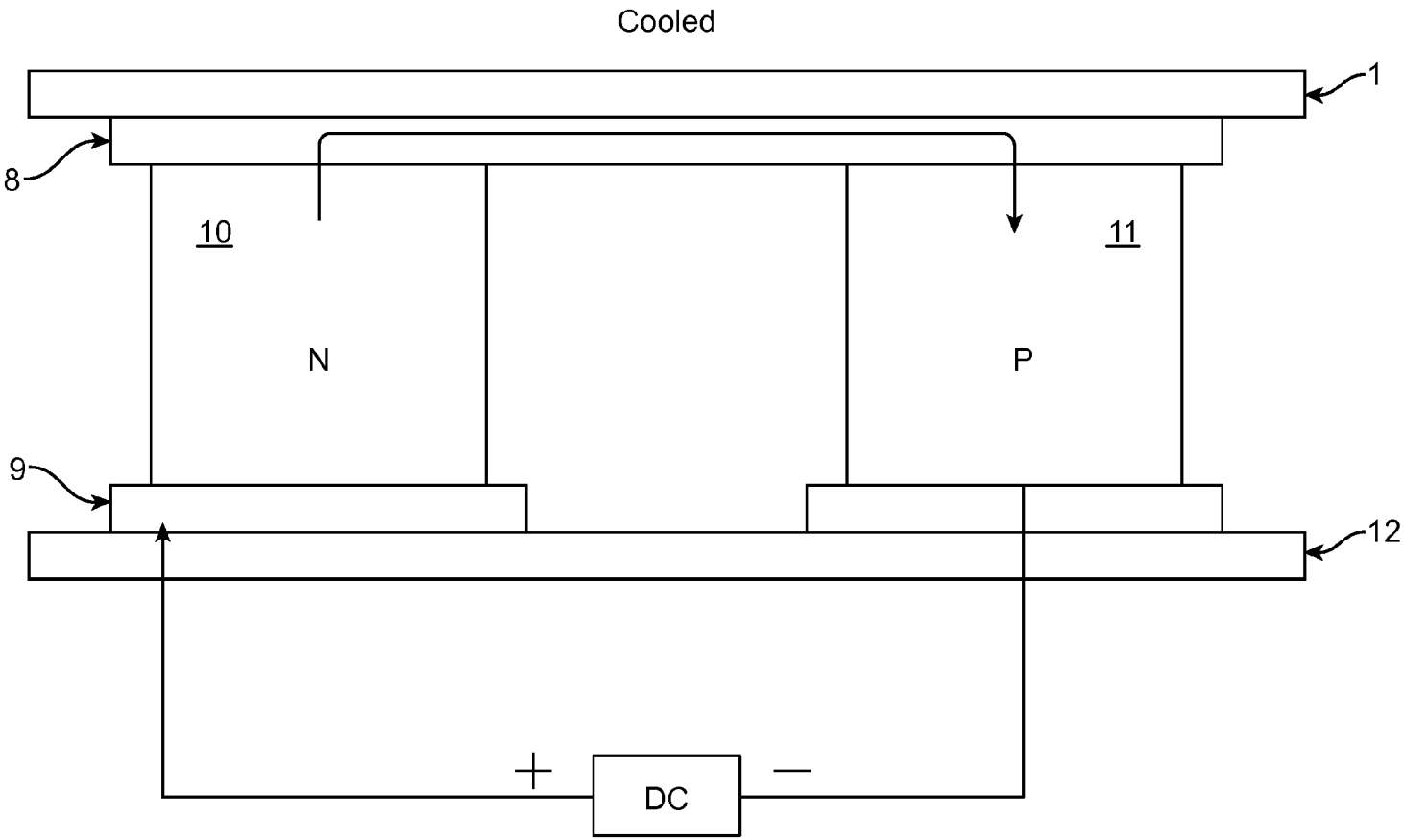
FIG. 5 is a schematic cross sectional view of a peltier element.
Figure 6:
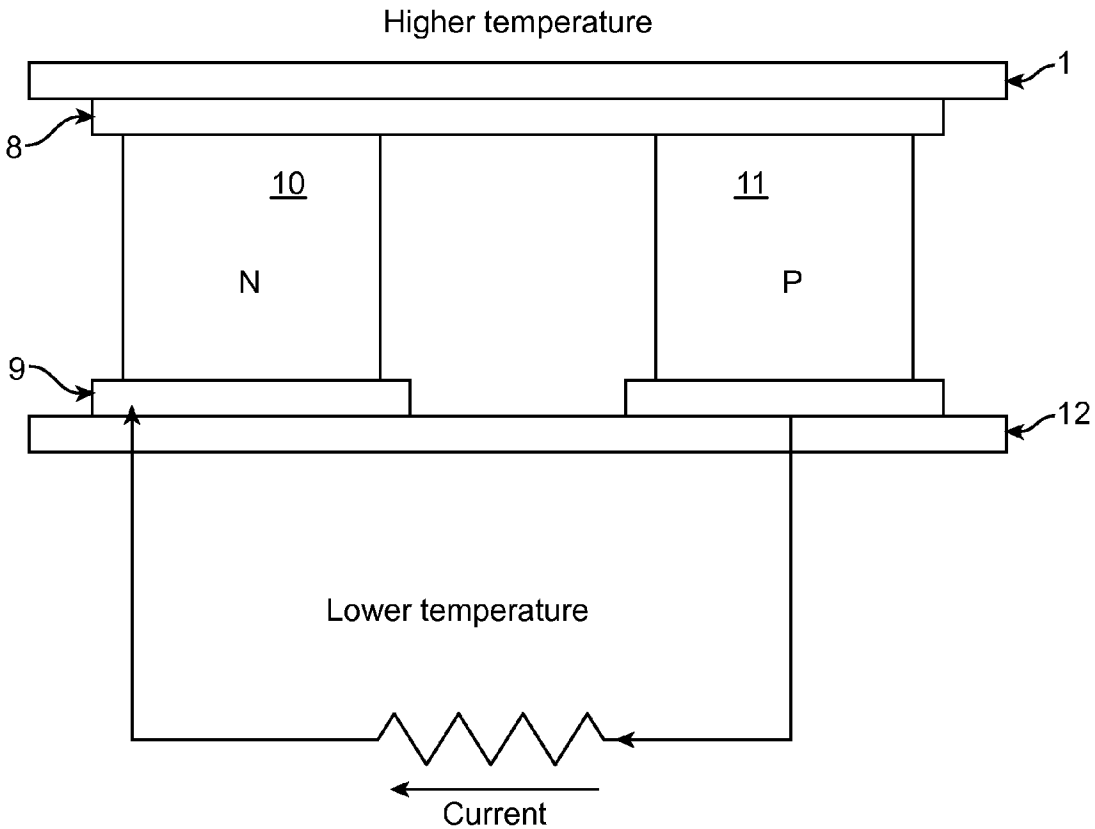
FIG. 6 is a schematic cross sectional view of a peltier element.

FIG. 5 shows a part of a peltier element formed in direct contact with the substrate 1 including a N type semiconductor 10 and a P type semiconductor 11. One end of the N type semiconductor 10 is connected to one side of an upper electrode 8. The other side of the upper electrode is connected to the P type semiconductor 11. The upper electrode 8 is formed in direct contact with the substrate 1. Each of the other ends of the P and N semiconductors 10-11 is connected to a corresponding lower electrode 9 formed in direct contact with a lower substrate 12. The electrodes 8 and 9 are made of a thin film of a metallic material such as gold, silver, copper, aluminum or the like having a thickness of less than 2 μm and formed by such method as printing, sputtering, depositing or plating. If the positive side of a DC power supply is connected to the N type semiconductor 10 through the corresponding lower electrode 9 on the right side of FIG. 5 and the negative side of the DC power supply is connected to the P type semiconductor 11 through the corresponding lower electrode 9 on the right side of FIG. 5, a current flows through both of the semiconductors in the direction indicated in FIG. 5. The current going through the junction of two different metals formed by the N type semiconductor 10 and the electrode 8, will remove heat from the electrode 8 by electrons having thermal energy moving from the upper electrode 8 through the N type semiconductor 10 to the lower substrate 12 through the lower electrode 9 due to the peltier effect. In a similar manner, the current going through the junction of two different metals formed by the P type semiconductor 11 and the upper electrode 8, will remove heat from the electrode 8 by holes having thermal energy moving from the electrode 8 through the P type semiconductor 11 to the lower substrate 12 through the lower electrode 9 due to the peltier effect. Thus, both electrons and holes of the respective semiconductors contribute to this transfer of the heat by the peltier effect. If the polarity of the DC power supply is reversed, then heat is removed from the lower substrate 12 and transferred to the substrate 1 by the peltier effect of the junction formed by the electrode and the semiconductor. The peltier element can also convert heat to electrical energy. As shown in FIG. 6, if a temperature of the substrate 1 is higher than a temperature of the lower substrate 12, this temperature difference causes both electrons and holes with thermal energy in the upper electrode 8 to diffuse to the N type semiconductor 10 and to the P type semiconductor 11 respectively removing heat from the substrate 1 through the upper electrode 8 and resulting in current flow in the direction as shown in FIG. 6. This current may be used for any purpose including operation of the thermal printhead or charging a rechargeable battery of such types as capacitor, nickel cadmium, nickel hydroxide, lithium ion, lithium polymer, or the like, for example.

In the embodiment of the present invention as shown in FIG. 4, the thermoelectric element 4 includes a plurality of upper electrodes 8, a plurality of lower electrodes 9, a first type semiconductor element 10, and a second type semiconductor element 11. This figure is merely an example that should not limit the scope of the claims. The upper electrode 8 can be formed in direct contact with the substrate 1 by printing a thin film of a metallic material such as gold, silver, copper, aluminum or the like having a thickness of less than 2 μm on one surface of the substrate 1. Alternately, the upper electrode 8 can also be formed by sputtering, depositing, plating or the like. The lower electrode 9 can also be formed from a metallic material such as gold, silver, copper, aluminum or the like by printing, sputtering, depositing, plating or the like on a surface of a lower substrate 12. Preferably, the lower substrate 12 is a substrate having a high thermal conductivity and may be attached to a heatsink 5.

As can be seen in FIG. 4, both the upper and lower electrodes 8-9 can be formed with a thin film of a metallic material providing both electrical and physical connection between the electrodes formed on the substrates and both of the first and second type semiconductors 10-11 formed thereon, while at the same time maximizing the thermal conductivity and minimizing the heat capacity of the thermal printhead. The first type semiconductor 10 is connected between one of the lower electrodes 9 and one of the upper electrodes 8 which is connected to the second type semiconductor 11 whose other end is connected to another one of the lower electrodes 9. The semiconductors 10-11 may be connected to their respective electrodes by soldering. A series of first and second type semiconductors 10-11 disposed in the manner as shown in FIG. 4 may form a peltier element. Of course, other manners of disposing the semiconductors are possible to form a peltier element. One surface of the lower substrate 12 may be attached to one side of a heatsink 5 and another side of the heatsink 5 may be attached to a casing of a thermal printer to induce a better heat dissipation. In an alternative, each of the first and second type semiconductors 10-11 can be attached to its respective upper or lower electrode 8 or 9 by utilizing a direct bonding technology or through a conductive adhesive.

In certain embodiments, a sensor 3 may be disposed in the thermal printhead. The sensor 3 may be positioned, for example, in an area adjacent to the resistor layer 2 on one surface of the substrate 1. The sensor 3 may be a thermistor, thermocouple, integrated circuit or the like formed on the substrate 1. The sensor 3 may also be disposed on a metal layer that is an extension of an electrode connecting the resistor layer 2 to a drive IC 6 supplying electrical power to the resistor layer 2. Having the sensor 3 on the metal layer may allow for a faster sensing of the temperature of the resistor layer 2, because the metal layer has a larger heat conductivity than ceramic, resin, glass or the like which may form the substrate 1.

Figure 7:
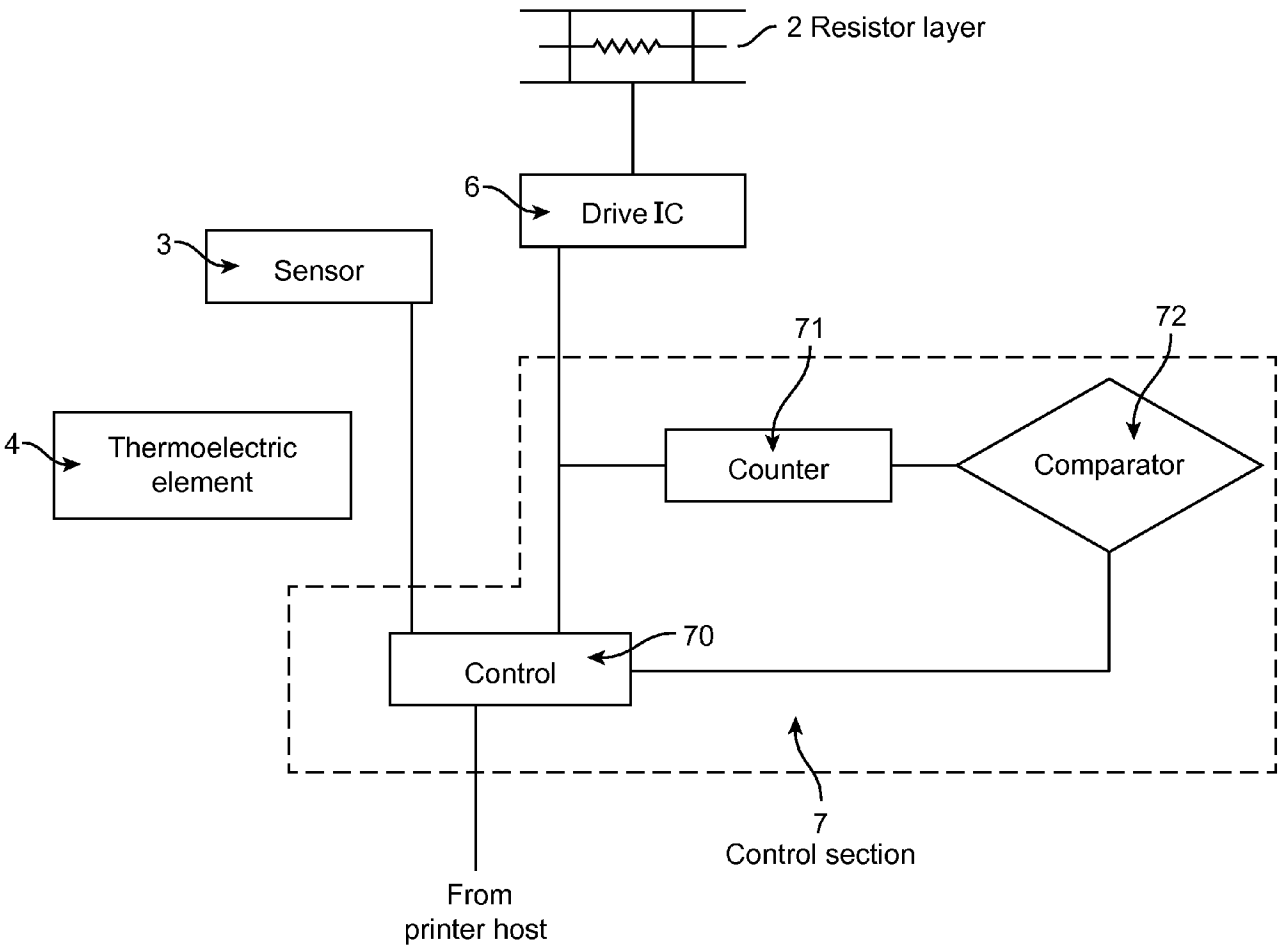
FIG. 7 is a schematic block diagram of electrical components in a thermal printhead according to an embodiment of the present invention.

FIG. 7 shows a schematic block diagram of an example of electrical components for regulating the temperature of the thermal printhead. The sensor 3 is connected to the control section 7 as shown in FIG. 7. The temperature of the resistor layer 2 sensed by the sensor 3 is fed back to the control section 7 which determines whether the sensed temperature is within a predetermined range. If the sensed temperature exceeds a predetermined temperature, the control section 7 turns on the thermoelectric element 4 to cool the resistor layer 2. This ensures that the resistor layer 2 stays within the predetermined range when, for example, an ambient temperature is so high that the preemptive cooling described below cannot keep up with the temperature buildup of the thermal printhead. The voltage supplied to the thermoelectric element 4 maybe increased in such a situation to allow for a stronger cooling.

The control section 7 is also configured to preemptively cool an area of the substrate 1 near the resistor layer 2 using the thermoelectric element 4 positioned near the area, when a cumulative amount of electrical power supplied to the resistor layer 2 within a unit time exceeds a predetermined amount. The cumulative amount of electrical power supplied within a unit time to the resistor layer 2 can be monitored by the control section 7, a CPU, or various appropriate circuits related to the operation of the thermal printhead.

The schematic block diagram shown in FIG. 7 is an example of electrical components for monitoring the cumulative amount of electrical power supplied within a unit time or in other words monitoring the rate of supplying electrical power to the resistor layer 2. The control section 7 is connected to the drive IC 6 which drives the resistor layer 2 by supplying dot producing signals. The control section 7 is also connected to the thermoelectric element 4. Included within the control section 7 are a counter 71 and a comparator 72. The counter 71 counts the number of dot producing signals supplied to the drive IC 6 within a unit time. When the number of dot producing signals within the unit time exceeds a predetermined number, the control section 7 turns on the thermoelectric element 4 to preemptively cool the resistor layer 2. This preemptive cooling allows reduction of the temperature buildup of the resistor layer 2 even before the temperature of the resistor layer 2 reaches a certain value detrimental to printing, resulting in a faster printing rate than the printing rate based on conventional natural cooling or even on a conventional forced cooling. The counter 71 and the comparator 72 may be disposed outside of the control section 7. The control section 7 may also be disposed outside of the substrate 1.

Figure 8:
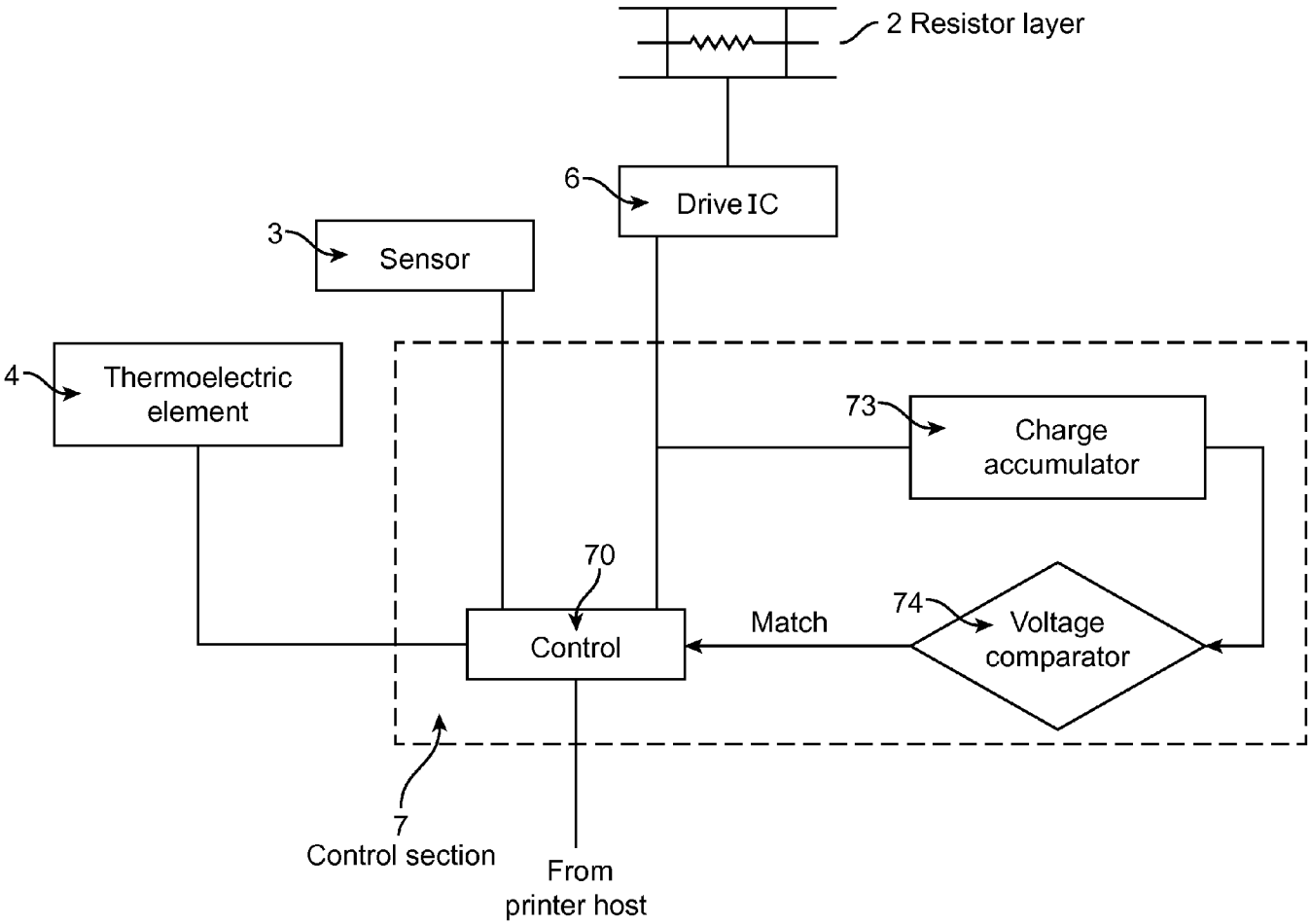
FIG. 8 is another schematic block diagram of electrical components in a thermal printhead according to an embodiment of the present invention.

FIG. 8 shows another example of monitoring the cumulative amount electrical power supplied within a unit time. The control section 7 includes a charge accumulator 73 and a voltage comparator 74 in place of the counter 71 and the comparator 72 respectively of the example shown in FIG. 7. The charge accumulator 73 may be a capacitor or the like which can accumulate electrical charge each time a dot producing signal is supplied to the drive IC 6. The voltage across the charge accumulator 73 increases proportional to the amount of accumulated charge in the charge accumulator 73. This voltage may be monitored periodically at a regular interval by the voltage comparator 74. If the voltage exceeds a predetermined voltage, the control section 7 turns on the thermoelectric element 4 to preemptively cool the resistor layer 2. Of course, the charge accumulator 71 and the voltage comparator 74 may also be located outside of the control section 7. In both examples, turning on and off of the thermoelectric element 4 can also be done in a gradual manner, in incremental steps, or in any appropriate manners. The voltage supplied to the thermoelectric element 4 may also be varied continuously, for example, based on a rate of the electrical power supplied to the resistor layer 2.

Figure 9:
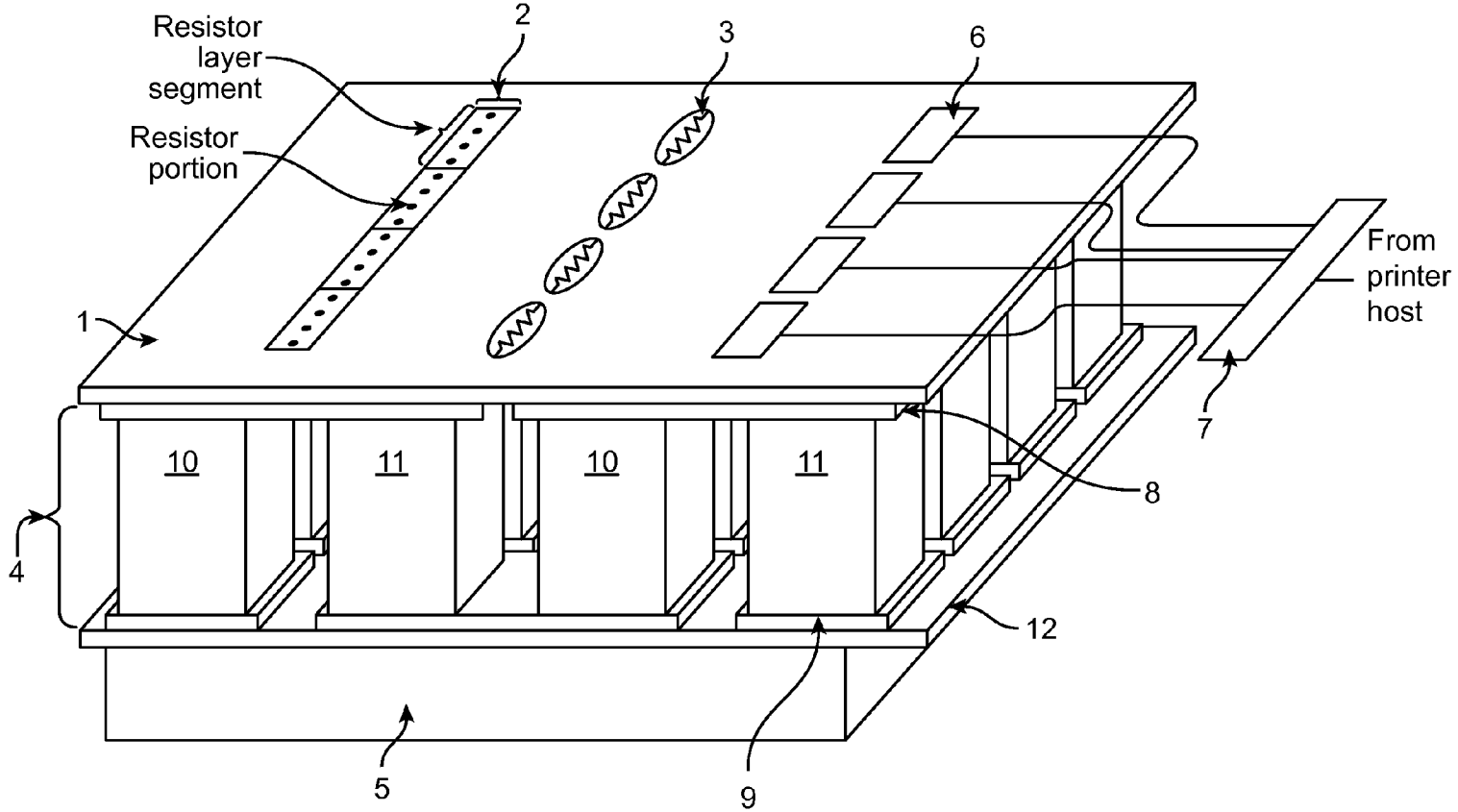
FIG. 9 is a schematic cross sectional view of a thermal printhead according to another embodiment of the present invention.

FIG. 9 illustrates a thermal printhead according to a second embodiment of the present invention. In this embodiment, the thermal printhead includes a plurality of thermoelectric elements 4 formed in direct contact with one surface of a substrate 1. The substrate 1 is made of ceramic, resin, metal, glass or the like. On the other surface of the substrate 1, the resistor layer 2 which is partitioned into a plurality of resistor layer segments is formed. The resistor layer segment is further partitioned into a plurality of resistor portions. The resistor portion constitutes a heating element for imprinting a dot on the thermosensitive paper. The resistor layer 2 can be formed by an essentially similar process to the process for forming the resistor layer 2 of the first embodiment.

Each of the plurality of thermoelectric elements 4 in this embodiment is formed in direct contact with the thermal printhead in a substantially similar manner to the first embodiment shown in FIG. 4. Each of the thermoelectric elements 4 includes a plurality of upper electrodes 8, a plurality of lower electrodes 9, a first type semiconductor element 10, and a second type semiconductor element 11. The upper electrode 8 can be formed in direct contact with the substrate 1 by printing a metallic material on one surface of the substrate 1. Alternately, the upper electrode 8 can also be formed by sputtering, CVD, plating or the like. The lower electrode 9 can also be formed from a metallic material by printing, sputtering, CVD, plating or the like on a surface of a lower substrate 12. Preferably, the lower substrate 12 is a substrate having a high thermal conductivity.

Similar to the first embodiment shown in FIG. 4, both the upper and lower electrodes 8-9 can be formed with a thin film of a metallic material providing both electrical and physical connection between the substrates and both first and second type semiconductors 10-11, while at the same time maximizing the thermal conductivity and minimizing the heat capacity of the thermal printhead. The first type semiconductor 10 is connected between one of the lower electrodes 9 and one of the upper electrodes 8 which is also connected to the second type semiconductor 11, whose other end is connected to another one of the lower electrodes 9. Each of the first and second type semiconductors 10-11 can be attached to its respective upper or lower electrode 8 or 9 by soldering. A series of first and second type semiconductors 10-11 disposed in the manner as shown in FIG. 4 may form a peltier element. Of course, other manners of disposing the semiconductors are possible to form a peltier element. One surface of the lower substrate 12 may be attached to one side of a heatsink 5 and another side of the heatsink 5 may be attached to a casing of a thermal printer to induce a better heat dissipation. In other alternatives, each of the first and second type semiconductors 10-11 can be attached to its respective upper or lower electrode 8 or 9 by utilizing a direct bonding technology or through a conductive adhesive.

In certain embodiments, a plurality of sensors 3 is disposed on the substrate 1. Each of the plurality of sensors 3 is positioned in an area near corresponding one of the plurality of resistor layer segments of the resistor layer 2 on a surface of the substrate 1. The sensor 3 can be a thermistor formed on the first surface of the substrate 1, for example. Each of the plurality of sensors 3 may be disposed on a metal layer that is an extension of an electrode connecting corresponding one of the plurality of resistor layer segments to a drive IC 6 supplying electrical power to the corresponding resistor layer segment. Having the sensor 3 on the metal layer may allow a faster sensing of the temperature of the area near corresponding one of the plurality of resistor layer segments, because the metal layer has a larger heat conductivity than ceramic, resin, glass or the like which may form the substrate 1. The sensor 3 is connected to the control section 7. The temperature sensed by the sensor 3 is fed back to the control section 7 which determines whether the sensed temperature is within a predetermined range. If the sensed temperature exceeds a predetermined temperature, the control section 7 turns on the thermoelectric element 4 to cool corresponding one of the resistor layer segments. This ensures that the resistor layer segment stays within the predetermined range when, for example, an ambient temperature is so high that the preemptive cooling described below cannot keep up with the temperature buildup of the thermal printhead. The voltage supplied to the thermoelectric element 4 may be increased in such a situation to allow for a stronger cooling.

The control section 7 is also configured to preemptively cool an area of the substrate 1 near one of the resistor layer segments using corresponding one of the thermoelectric elements 4 positioned near the area when a cumulative amount of electrical power supplied to the one of the resistor layer segments within a unit time exceeds a predetermined amount. In a similar manner to the first embodiment as described above in relation to and shown in FIG. 2, the cumulative amount of electrical power supplied within an unit time to the one of the resistor layer segments of the resistor layer 2 can be measured by a similar arrangement of the electrical components to FIGS. 7-8.

It will be apparent to those skilled in the art that various modification and variations can be made in the thermal printhead of the present invention without departing from the spirit or scope of the invention. Thus, it is intended that the present invention cover modifications and variations that come within the scope of the appended claims and their equivalents.

What is claimed is:

1. A thermal printhead comprising:

a substrate;

a resistor layer formed on one surface of the substrate;

a control section; and a thermoelectric element formed in direct contact with the other surface of the substrate opposite to where the resistor layer is formed, wherein the control section is configured to cool the resistor layer using the thermoelectric element.

2. The thermal printhead according to claim 1, wherein the thermoelectric element comprises an upper electrode formed in direct contact with the other surface of the substrate having one side of a semiconductor electrically and physically connected thereto, and a lower electrode formed in direct contact with a lower substrate having the other side of the semiconductor electrically and physically connected thereto, and wherein the upper and lower electrodes are formed by one of printing, sputtering, depositing, and plating a thin metallic material with a thickness of less than 2 μm on the substrate and on the lower substrate.

3. The thermal printhead according to claim 2, further comprising a sensor disposed adjacent to the resistor layer, wherein the control section is configured to maintain the temperature of the resistor layer within a predetermined range by heating or cooling the resistor layer using the thermoelectric element based on the temperature of the resistor layer sensed by the sensor.

4. The thermal printhead according to claim 3, wherein the thermoelectric element is attached to a heatsink.

5. The thermal printhead according to claim 1, wherein the control section is configured to cool the resistor layer using the thermoelectric element based on a rate of electrical power supplied to the resistor layer.

6. The thermal printhead according to claim 1, wherein the control section is configured to cool the resistor layer using the thermoelectric element when a cumulative amount of electrical power supplied to the resistor layer within a unit time exceeds a predetermined amount.

7. The thermal printhead according to claim 1, wherein the control section is configured to preemptively cool the resistor layer using the thermoelectric element.

8. The thermal printhead according to claim 1, wherein the control section is configured to cool the resistor layer using the thermoelectric element by continuously varying voltage supplied to the thermoelectric element based on the rate of electrical power supplied to the resistor layer.

9. The thermal printhead according to claim 6, further comprising a sensor disposed adjacent to the resistor layer, wherein the control section is configured to maintain the temperature of the resistor layer within a predetermined range by heating or cooling the resistor layer using the thermoelectric element based on the temperature of the resistor layer sensed by the sensor.

10. The thermal printhead according to claim 9, wherein the thermoelectric element is disposed on a heatsink.

11. The thermal printhead according to claim 1, wherein the control section detects a predetermined amount of current generated by the thermoelectric element when a temperature difference between a resistor layer side of the thermoelectric element and an opposite side of the thermoelectric element becomes large enough to generate the current, and the control section is configured to switch the thermoelectric element to cool the resistor layer for a unit time.

12. The thermal printhead according to claim 11, wherein the control section is configured to cool the resistor layer using the thermoelectric element when a cumulative amount of electrical power supplied to the resistor layer within a unit time exceeds a predetermined amount.

13. The thermal printhead according to claim 12, further comprising a sensor disposed on the opposite side of the thermoelectric element, wherein the control section is configured to maintain the temperature of the resistor layer within a predetermined range by heating the resistor layer using the thermoelectric element when the temperature of the opposite side of the thermoelectric element sensed by the sensor is below a first predetermined temperature and no current is generated by the thermoelectric element, and by cooling the resistor layer using the thermoelectric element when the temperature is above a second predetermined temperature and the predetermined amount of current generated by the thermoelectric element is detected by the control section.

14. A thermal printhead comprising:

a substrate;

a resistor layer formed on one surface of the substrate wherein the resistor layer is partitioned into a plurality of resistor layer segments, the resistor layer segment is further partitioned into a plurality of resistor portions, and the resistor portion constitutes a heating element;

a plurality of thermoelectric elements formed in direct contact with the other surface of the substrate opposite to where the resistor layer is formed; and a control section, wherein each of the plurality of thermoelectric elements is formed in direct contact with the opposite surface of the substrate where corresponding one of the plurality of resistor layer segments is formed, and wherein the control section is configured to cool the resistor layer segment using corresponding one of the thermoelectric elements.

15. The thermal printhead according to claim 14, wherein each of the plurality of thermoelectric elements comprises an upper electrode formed in direct contact with the other surface of the substrate having one side of a semiconductor electrically and physically connected thereto, and a lower electrode formed in direct contact with a lower substrate having the other side of the semiconductor electrically and physically connected thereto, and wherein the upper and lower electrodes are formed by one of printing, sputtering, depositing, and plating a thin metallic material with a thickness of less than 2 μm on the substrate and on the lower substrate respectively.

16. The thermal printhead according to claim 15, further comprising a plurality of sensors formed on the substrate, each of the plurality of sensors disposed adjacent to corresponding one of the plurality of resistor layer segments, wherein each sensor senses the temperature of corresponding one of the resistor layer segments and when the sensed temperature is outside of a predetermined range, corresponding one of the thermoelectric elements is configured to heat or cool the corresponding one of resistor layer segments so that the temperature is maintained within a predetermined range.

17. The thermal printhead according to claim 16, wherein the plurality of thermoelectric elements is attached to a heatsink.

18. The thermal printhead according to claim 14, wherein the control section is configured to cool the resistor layer segment using corresponding one of the thermoelectric elements based on a rate of electrical power supplied to the resistor layer segment.

19. The thermal printhead according to claim 14, wherein the control section is configured to cool the resistor layer segment using corresponding one of the thermoelectric elements when a cumulative amount of electrical power supplied to the resistor layer segment within a unit time exceeds a predetermined amount.

20. The thermal printhead according to claim 19, further comprising a plurality of sensors formed on the substrate, each of the plurality of sensors disposed adjacent to corresponding one of the plurality of resistor layer segments, wherein each sensor senses the temperature of corresponding one of the resistor layer segments and when the sensed temperature is outside of a predetermined range, corresponding one of the thermoelectric modules is configured to heat or cool the corresponding one of the resistor layer segments so that the temperature is maintained within the predetermined range.

21. The thermal printhead according to claim 20, wherein the plurality of thermoelectric elements is disposed on a heatsink.

22. The thermal printhead according to claim 14, wherein the control section is configured to preemptively cool the resistor layer segment using corresponding one of the thermoelectric elements.

23. The thermal printhead according to claim 14, wherein the control section is configured to cool the resistor layer segment using corresponding one of the thermoelectric elements by continuously varying voltage supplied to the corresponding one of the thermoelectric elements based on the rate of electrical power supplied to the resistor layer.

* * * * *